US005320013A

United States Patent [19]

Nonami et al.

[11] Patent Number: 5,320,013

[45] Date of Patent: Jun. 14, 1994

[54] METHOD OF BLANKING METAL FOIL ON PIEZOELECTRIC ACTUATOR OPERATED PRESS, AND DIE SETS FOR PRACTICING THE METHOD

[75] Inventors: Mitsuharu Nonami; Yukinori Kawamura; Kozo Matsumoto; Norikatsu Matsumoto; Fumisato Niino, all of Kanagawa, Japan

[73] Assignee: Fuji Electric Co., Ltd., Kanagawa, Japan

[21] Appl. No.: 977,752

[22] Filed: Nov. 17, 1992

Related U.S. Application Data

[63] Continuation-in-part of Ser. No. 843,280, Feb. 28, 1992, abandoned.

[30] Foreign Application Priority Data

Jun. 20, 1991 [JP] Japan ..... 3-176163

[51] Int. Cl.[5] ..... B26F 3/00

[52] U.S. Cl. ..... 83/25; 83/13; 83/575; 83/623; 83/685

[58] Field of Search ..... 83/51, 13, 575, 577, 83/623, 685, 25; 72/430

[56] References Cited

U.S. PATENT DOCUMENTS

| | | | |
|---|---|---|---|
| 3,700,150 | 10/1972 | Cheney | 83/13 X |
| 3,878,746 | 4/1975 | Carmelli | 83/51 X |
| 4,362,078 | 12/1982 | Ohnishi et al. | 83/51 X |
| 4,477,537 | 10/1984 | Blase et al. | 83/51 X |
| 5,095,725 | 3/1992 | Wada et al. | 72/32 |
| 5,163,223 | 11/1992 | Wurster | 83/51 X |
| 5,205,147 | 4/1993 | Wada et al. | 73/430 X |

*Primary Examiner*—Richard K. Seidel
*Assistant Examiner*—Kenneth E. Peterson
*Attorney, Agent, or Firm*—Finnegan, Henderson Farabow, Garrett & Dunner

[57] ABSTRACT

In blanking a metal foil on a press comprising a pair of dies, a pair of punches, and a pair of piezoelectric actuators for driving the punches with are all arranged above and below the metal foil, the punches are vertically vibrated by the piezoelectric actuators, so that, while the punches being held abutted against both surfaces of the metal foil clamped between the dies, a half blanking operation and a reverse blanking operation are carried out alternately, whereby the metal foil is cut along the shearing surface through low cyclic fatigue without formation of burrs.

8 Claims, 8 Drawing Sheets

CUT END FACE

CUT END FACE

METHOD OF BLANKING METAL FOIL ON PIEZOELECTRIC ACTUATOR OPERATED PRESS, AND DIE SETS FOR PRACTICING THE METHOD

BACKGROUND OF THE INVENTION

This is a continuation-in-part of application Ser. No. 843,280, filed Feb. 28, 1992, now abandoned.

This invention relates to a method of blanking a workpiece such as a metal foil on a press which is operated with piezoelectric actuators as punch driving sources, and to the structure of die sets for practicing the method.

Recently, precision parts manufactured by shearing have been remarkably improved in accuracy and in quality because of the progress of shearing technique and die manufacturing technique, and the improved performance of the press. In the field of manufacturing precision parts which must be of the order of microns in precision, it has been tried to employ a method of manufacturing electronic parts such as lead frames be shearing which are heretofore formed by etching.

On the other hand, a press for blanking a thin metal foil, less than 100 μm in thickness, with high precision has been well known in the art. More specifically, Japanese Patent Application (OPI) No. 127997/1990 (the term "OPI" as used herein means an "unexamined published application") has disclosed a press which performs a reciprocating operation to blank a material or workpiece with piezoelectric actuators as punch driving sources with produce shearing power.

FIG. 5 shows a schematic representation of the above-described press of reciprocating blanking system which is operated by piezoelectric actuators. As shown in FIG. 5, a frame 1 accommodates various components such as an upper die set 2, lower die set 3, movable stripper 4, upper die 5, lower die 6, upper punch 7, lower punch 8, and piezoelectric actuators 9 for operating the stripper 4. Casings 1*a* and 1*b* are mounted on the top and bottom of the frame 1, respectively. The casing 1a accommodates a piezoelectric actuator 10 for driving the upper punch 7, a movable piece 12*a* (which is a rod member for transmitting the displacement of the piezoelectric actuator to the punch) and a preloading spring 13*a*. Similarly, the casing 1*b* accommodates a piezoelectric actuator 11 for driving the lower punch 8, a movable piece 12*b* (which is a rod member for transmitting the displacement of the piezoelectric actuator to the punch) and a preloading spring 13*b*. Further in FIG. 5, reference numeral 14 designates screws which secure the die sets 2 and 3 inside the frame 1; 15, springs for energizing the movable stripper 4; and 16, return springs for returning the punches 7 and 8.

The blanking of a workpiece 17 such as a metal foil on the press thus constructed is carried out as follows:

The piezoelectric actuators 9 are operated to move the movable stripper 4 upwardly thereby to form a space between the upper and lower dies 5 and 6. Under this condition, the workpiece 17 is fed into the space between the upper and lower dies 5 and 6, and then the piezoelectric actuators 9 are restored so that the workpiece 17 is clamped between the upper and lower dies 5 and 6. Thereafter, by applying voltage to the piezoelectric actuators 10 and 11, the upper punch 7 and the lower punch 8 are protruded alternately; that is, the workpiece 17 is blanked by so-called "vertical blanking". After the blanking of the workpiece has been accomplished, the piezoelectric actuators 9 are operated again to move the movable stripper 4 upwardly, thereby to release the workpiece 17. The workpiece 17 thus released is conveyed a predetermined distance to the following processing position.

The aforementioned reciprocating blanking method will be described with reference to FIG. 6 in more detail. The part (a) of FIG. 6 shows an initial state that the workpiece 17 is clamped between the upper die 5 and the lower die 6. In the initial state, both the upper punch 7 and the lower punch 8 are held retracted. When, under this condition, voltage is applied to the piezoelectric actuator 10 (FIG. 5), as shown in the part (b) of FIG. 6 the upper punch 5 is moved downwardly to go into the workpiece 17, thus deforming the latter 17 from above by shearing; that is, the workpiece is half blanked (hereinafter referred to as "half blanking", when applicable). Thereafter, while the upper punch 17 is moved upwardly, voltage is applied to the piezoelectric actuator 11 to move the lower punch 8 upwardly thereby to deform the workpiece 17 from below in such a manner that the part of the workpiece which has been deformed by the above-described half blanking operation is pushed back, as shown in the part (c) of FIG. 6 (hereinafter referred to as "reverse blanking", when applicable). As a result, a part 17*a* is formed by blanking (hereinafter referred to as "a blanked part 17*a*", when applicable); that is, it is separated from the workpiece 17 being moved along the shearing surface. In the last step, the upper punch 7 is operated as shown in the part (d) of FIG. 6, so that the blanked part 17*a* is pushed back into the workpiece 17 from the upper die 5.

FIG. 7 is a microphotography of the sheared face of a copper foil 80 μm in thickness which has been sheared by the aforementioned reciprocating blanking method. As is seen from the picture, sheared surfaces are formed in the upper and lower portions of the cut end face, and a rupture surface in the middle. In this experiment, the dies employed were such that the clearance was 2% of the thickness of the copper foil on the side of the punch used for the half blanking operation, and 4% on the side of the punch used for the reverse blanking operation.

The present inventors have found it through a number of experiments that, in shearing, a thin metal foil less than 50 μm by reciprocating blanking, the accuracy in position of the punches and the clearances of the dies greatly affect the accuracy of manufacture. In blanking a workpiece according to the above-described reciprocating blanking method, in general a satisfactory sheared surface can be obtained when the die clearance is less than 10% of the workpiece. However, in the case where a metal foil several tens of micrometers in thickness is blanked with an intricate blanking contour, it is considerably difficult to set the die clearance to a suitable value less than 10% of the thickness of the metal foil. Hence, in blanking a hard workpiece such as a metal foil of stainless steel, burrs are formed on the cut end face formed by shearing.

FIG. 8 is a mircophotography of the section of the cut end face of the copper foil shown in FIG. 7 which is revealed immediately after the reverse blanking operation. The cut end face of the right-handed part of the workpiece has a bur at the lower end. Thus, if, in blanking a workpiece according to the conventional reciprocating blanking method, the workpiece is small in thickness, burrs are liable to be formed on the cut end face; that is, the resultant product is unsatisfactory in the quality of a sheared surface.

SUMMARY OF THE INVENTION

In view of the foregoing, an object of this invention is to provide a method of accurately blanking a metal foil less than several tens of micrometers in thickness on a piezoelectric actuator operated press without forming burrs, and die sets for practicing the method.

In a method of blanking a metal foil on a press according to the invention, a pair of punches are vertically vibrated by a pair of piezoelectric actuators, respectively, so that, while the punches being held abutted against both surfaces of a metal foil clamped between said a pair of dies, a half blanking operation and a reverse blanking operation are carried out alternately, to blank the metal foil.

In each of the half blanking operation and reverse blanking operation, the amount of movement of the punch is 10 to 40% of the thickness of the metal foil; and in association with the half blanking operation and the reverse blanking operation, the piezoelectric actuators are alternately activated by application of positive voltage to vertically vibrate the punches. Furthermore, in the method, in order to positively retain the metal foil under pressure, after positive voltage is applied to one of the of piezoelectric actuators, negative voltage is applied to the other with a slight time delay.

In addition, either the edges of the dies or those of the punches are chamfered, to avoid the formation of burrs in the case the die clearance is large when compared with the thickness of the metal foil.

As was described above, with the punches abutted against both surfaces of the metal foil clamped between the dies, the piezoelectric actuators drive the punches distances (10 to 40% of the thickness of the metal foil) shorter than those in the conventional reciprocating blanking method so as to perform the half blanking operation and the reverse blanking operation alternately. As a result, the metal foil is sheared by the punches going therein from above and below, and is ruptured along the shearing surface by low cyclic fatigue. Thus, the blanking of the metal foil is achieved without formation of burrs.

The piezoelectric actuators are alternately activated by application of positive signal, to alternately drive the upper and lower punches, or after positive voltage is applied to one of the piezoelectric actuators, negative voltage is applied to the other with a slight time delay; that is, the elastic characteristics of the piezoelectric actuators, and the hysteresis characteristic of displacement with voltage thereof are effectively utilized. Therefore, with the metal foil retained under pressure, the half blanking operation and the reverse blanking operation can be carried out. In addition, since the punches are held abutted against both surfaces of the metal foil, the latter is prevented from being bent during blanking.

In the case where the die clearance is large, 50 to 100% of the thickness of the metal foil, stress is concentrated on both sides of the clearance when the half blanking operation and the reverse blanking operation are repeatedly carried out, as a result of which burrs may be formed by double shearing. This difficulty can be eliminated by chamfering either the edges of the dies or those of the punches. That is, the concentration of stress on the metal foil is lessened on the side of the chamfered edges, and therefore the occurrence of double shearing, and accordingly the formation of burrs is avoided. Thus, the resultant product shows excellent cut end faces.

The nature, utility and principle of the invention will be more clearly understood from the following detailed description and the appended claims when read in conjunction with the accompanying drawing.

DETAILED DESCRIPTION OF THE INVENTION

Preferred embodiments of this invention will be described with reference to the accompanying drawings.

Figure 1:
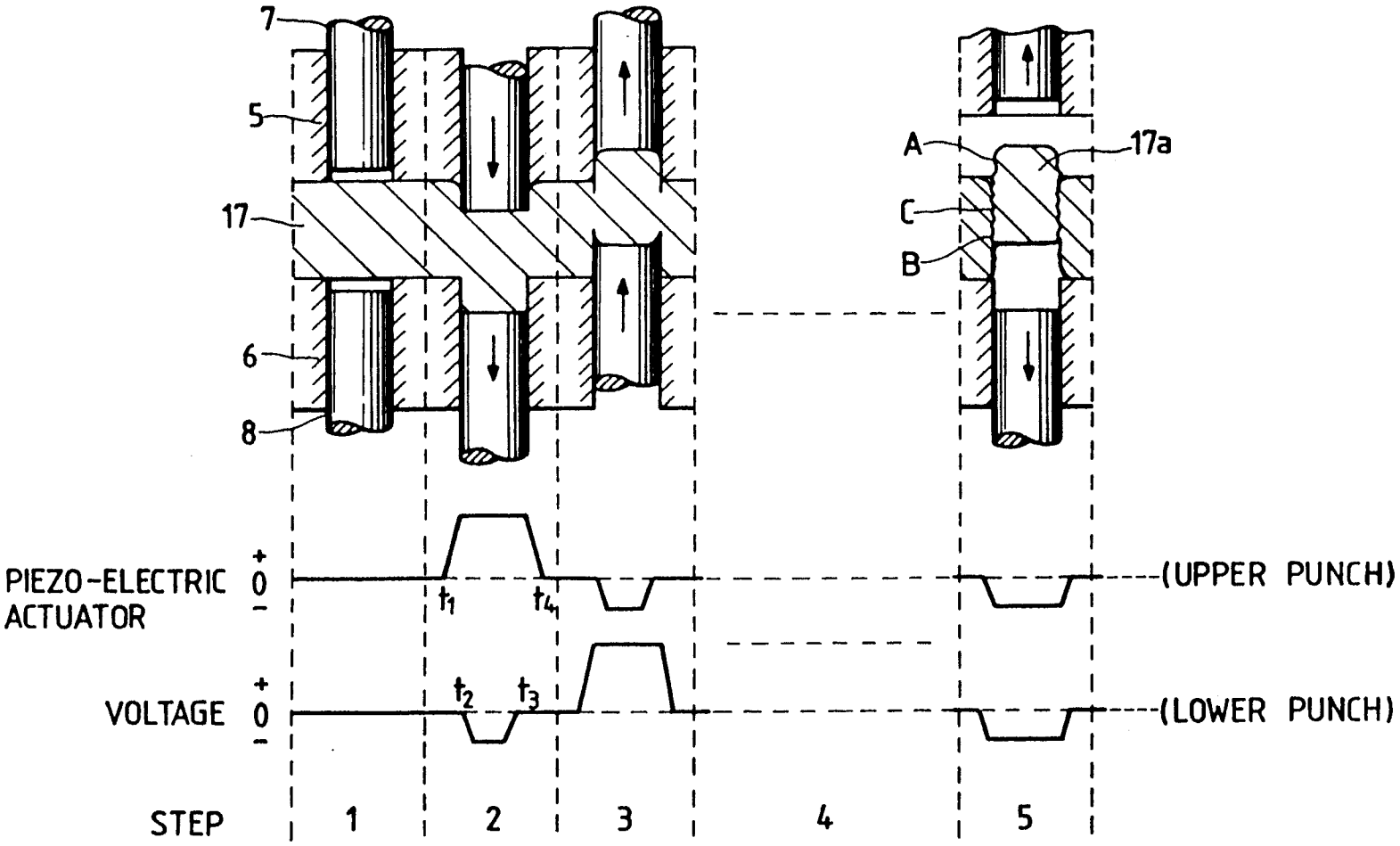
FIG. 1 is an explanatory diagram for a description of one example of a method of blanking a workpiece such as a metal foil on a press according to this invention, showing voltages applied to piezoelectric actuators and movements of upper and lower punches driven by the piezoelectric actuators.
Figure 2A:
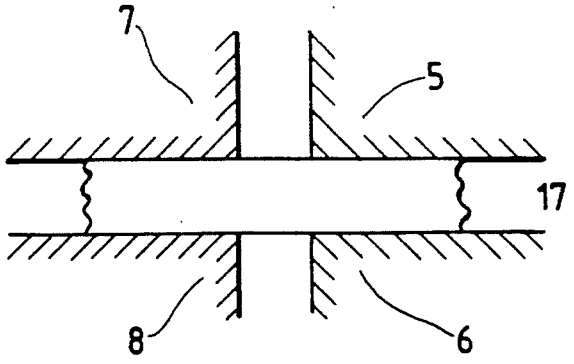
FIG. 2 shows how a metal foil is blanked when the dies provide relatively large clearances—more specifically, the part (a) of FIG. 2 is an explanatory diagram showing the workpiece clamped between the dies, the part (b) an explanatory diagram showing the workpiece is punches midway from above (a half blanking operation), the part (c) an explanatory diagram showing the workpiece is punched from below (a reverse blanking operation), and the part (d) an explanatory diagram showing the cut end face of the workpiece thus punched.
Figure 2B:
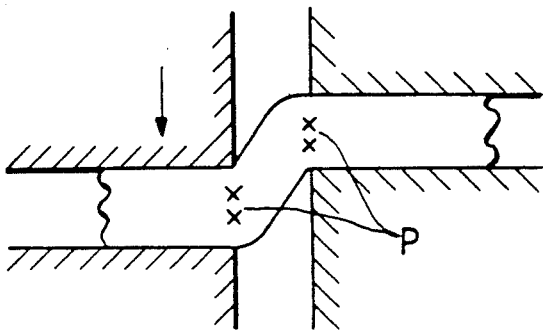
Figure 2C:
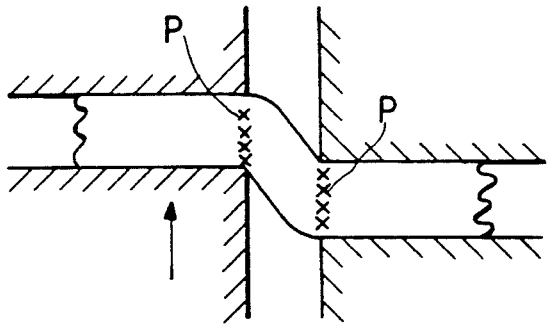
Figure 2D:
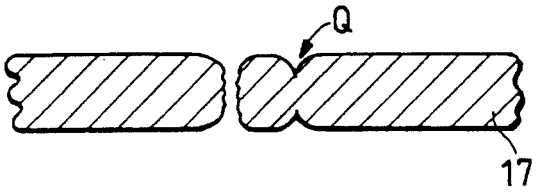
Figure 5:
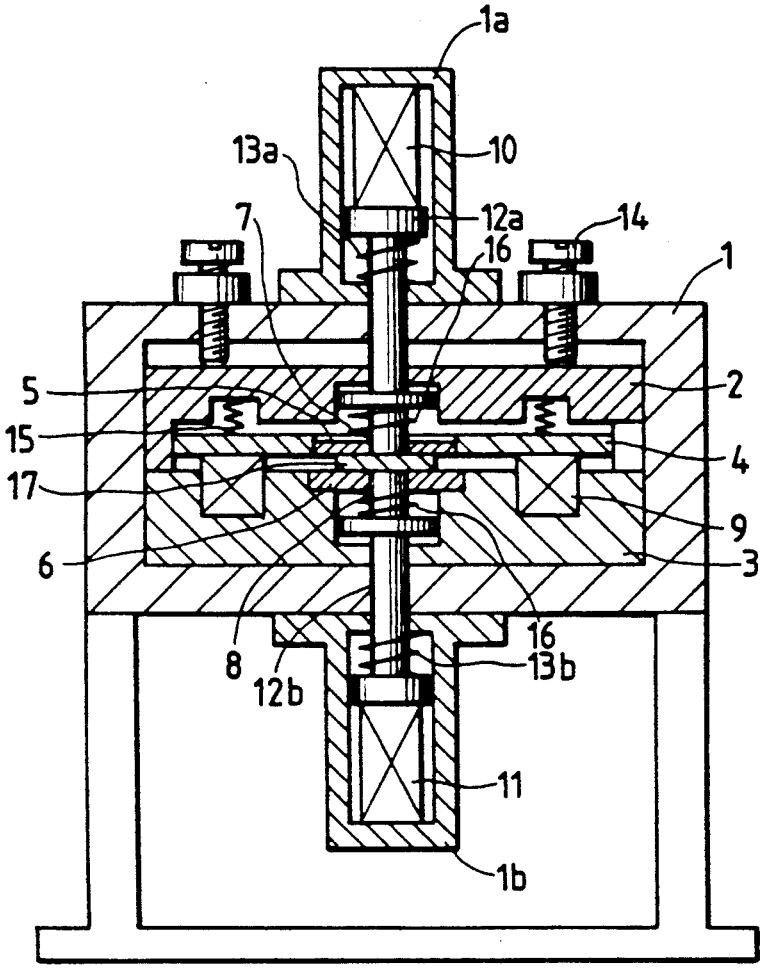
FIG. 5 is an explanatory diagram showing the arrangement of a piezoelectric actuator operated press which practices the method of the invention.
Figure 6A:
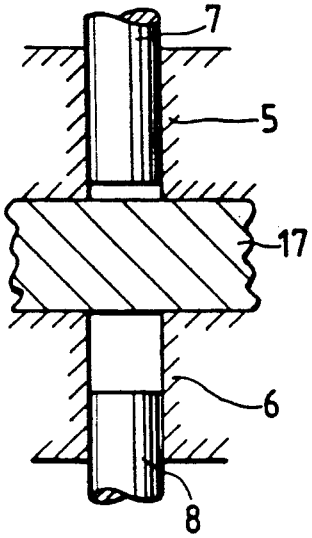
FIG. 6 shows a conventional reciprocating blanking method—more specifically, the part (a) of FIG. 6 is an explanatory diagram showing an initial step in which a workpiece is clamped between dies; the part (b) an explanatory diagram showing a second step in which an upper punch is moved to go into the workpiece midway (a half blanking operation), the part (c) an explanatory diagram showing a third step in which a lower punch is moved in the opposite direction (a reverse blanking operation), and the part (d) an explanatory diagram showing a final step in which the part cut from the workpiece is pushed back into the workpiece.
Figure 6B:
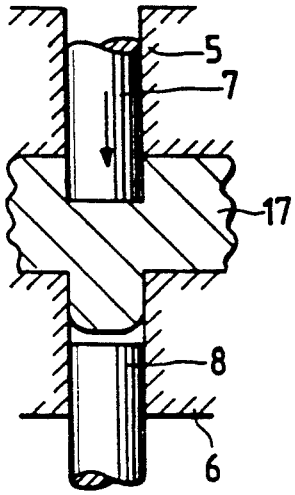
Figure 6C:
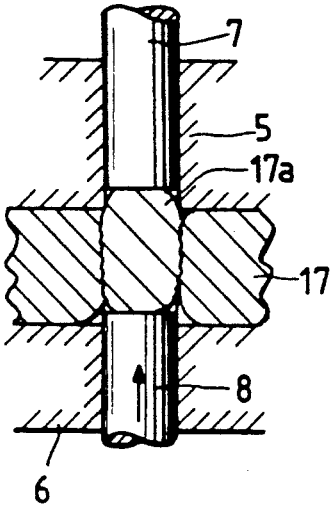
Figure 6D:
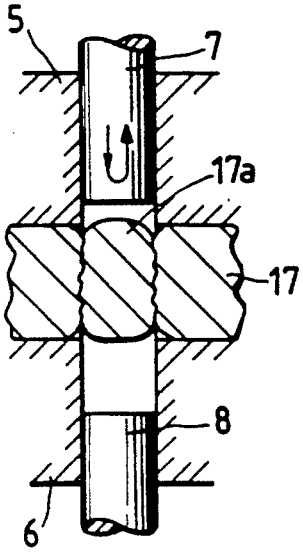
Figure 7:
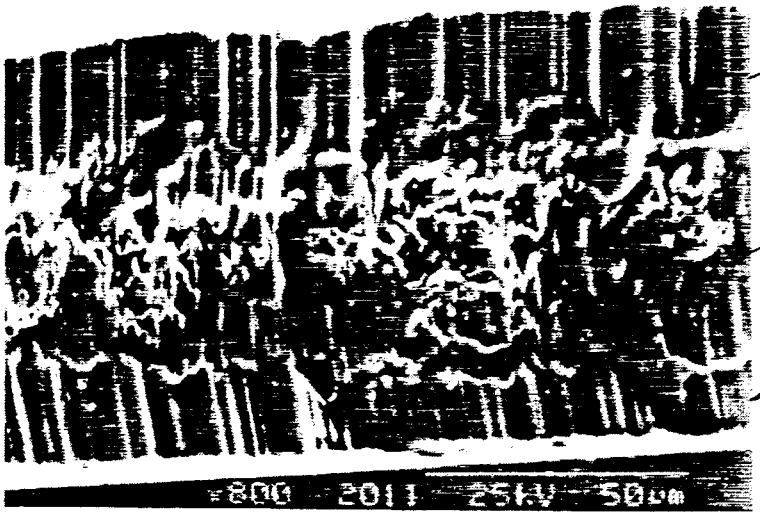
FIG. 7 is a microphotograph of the cut end face of a specimen blanked according to the conventional reciprocating blanking method, which is taken from before.
Figure 8:
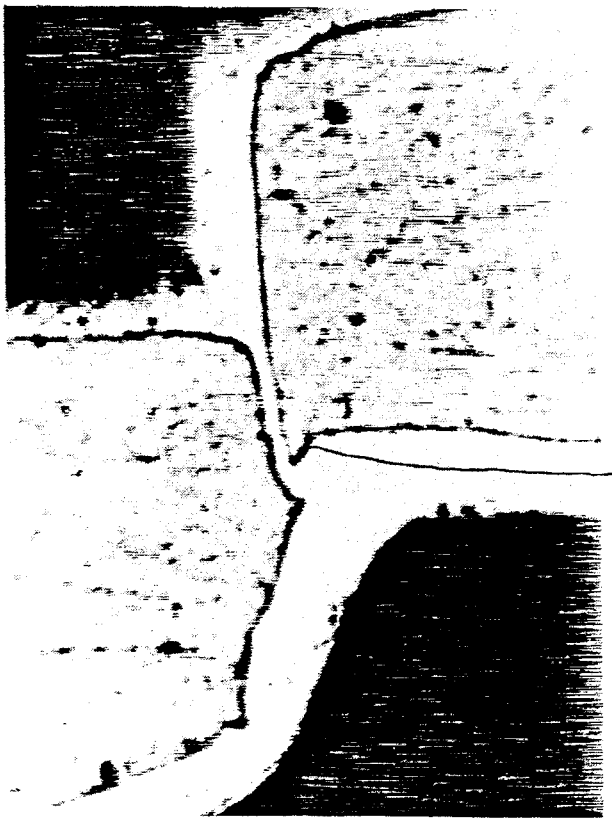
FIG. 8 is a microphotograph of the section of the cut end face shown in FIG. 7.

FIG. 1 is an explanatory diagram for a description of one example of a metal foil blanking method according to the invention. An example of a product which can be manufactured by the method of the present invention is a 1.8 inch stainless steel HDD magnetic head having a thickness of 20 micrometers and outer dimensions of 5 millimeters × 15 millimeters. For practicing the method, the same kind of piezoelectric actuator operated press as described with reference to FIG. 5 is employed. In FIG. 1, parts corresponding functionally to those which have been described with reference to FIG. 5 are therefore designated by the same reference numerals or characters. The upper portion of FIG. 1 shows the movements of the upper and lower punches 7 and 8 and the resultant deformations of a workpiece 17, with steps 1 through 5. The middle portion of FIG. 1 shows the displacement of the upper and lower punches throughout the punching operation. The lower portion of FIG. 1 shows voltages applied to the piezoelectric actuators provided for the upper and lower punches. Those piezoelectric actuators drive the punches as follows: That is, in response to positive voltage, the piezoelectric actuators move the upper and lower punches towards the workpiece 17, and in response to negative (1) voltage, they move the punches away from the workpiece 17, according to the hysteresis characteristic curve.

In step 1, the workpiece 17 is held between the upper die 5 and the lower die 6, and both of the upper and lower punches 7 and 8 are held at initial positions spaced form the workpiece 17 (being placed in the initial state). In step 2, a small positive voltage is applied to the lower punch 8 at the time $t_1$ to bring the lower punch 8 into contact with the workpiece 17. The displacement curve for the lower punch shows the corresponding upward movement.

In step 3, a half blanking operation is performed. A positive voltage is applied to the upper punch 7 at $t_2$ to move the upper punch 7 toward the workpiece 17 while a positive voltage is still applied to the lower punch 8. As a result, the upper punch 7 goes into the workpiece 17 which is held between the upper and lower punches 7, 8, and the workpiece 17 is deformed by shearing. At the time t , a positive voltage is no longer applied to the lower punch $t_3$. At this time, the piezoelectric actuator 11 for the lower punch 8 is held contracted according to its own spring constant in actuation with the movement of the upper punch 7. At the time $t_4$, a negative voltage is applied to the lower punch 8 to further retract the lower punch 8. Thus, the upper punch 7 is moved a predetermined distance (about 10% to 40% of the thickness of the workpiece 17) while the workpiece 17 is being held by both the upper and lower punches. The displacement curves for the upper and lower punches show the corresponding downward movement of both punches.

In step 4, a reverse blanking operation is performed. At the time $t_5$, a positive voltage is applied to the lower punch 8 to move the lower punch toward the workpiece 17 while a positive voltage is still applied to the upper punch 7. As a result, the lower punch 8 goes into the workpiece 17 which is held between the upper and lower punches to further deform the workpiece 17 by shearing. The piezoelectric actuator 10 for the upper punch 7 is held contracted according to its own spring constant in actuation with the movement of the lower punch 8 until the time $t_6$ where the upper punch is further retracted by applying a negative voltage to the upper punch 7. In step 5, steps 3 and 4 are repeated several times until a blanked part 17*a* is punched from the workpiece 17. The cut end face of the blanked part 17*a* has shear surfaces A and B which were formed when the punches were caused to go into the workpiece from above and below, and a rupture surface C between the sheared surfaces A and B which was formed through low cyclic fatigue. The displacement curves for the upper and lower punches show the corresponding upward movement of both punches.

At the beginning of step 6, the blanked part 17*a* has been sheared from the workpiece 17. In step 6, a push-back operation is performed to align the blanked part 17*a* with the workpiece 17. At the time $t_7$, a positive voltage is applied to move the lower punch 8 into contact with the blanked part 17*a*. At the time $t_8$, a positive voltage is applied to the upper punch 7 to push the blanked part 17*a* into alignment with the workpiece 17. At the time $t_9$, negative voltages are applied to both the upper and lower punches to move the upper and lower punches away from the blanked part 17*a*. The workpiece 17 is then released by the dies 5, 6 and moved to the next blanking position.

Figure 9:
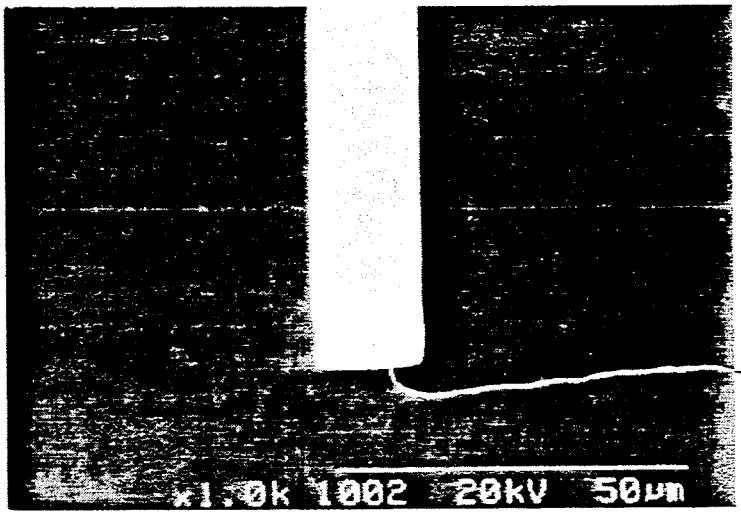
FIG. 9 is a microphotograph of the section of the cut end face of a specimen which has been blanked according to the method of the invention.
Figure 10:
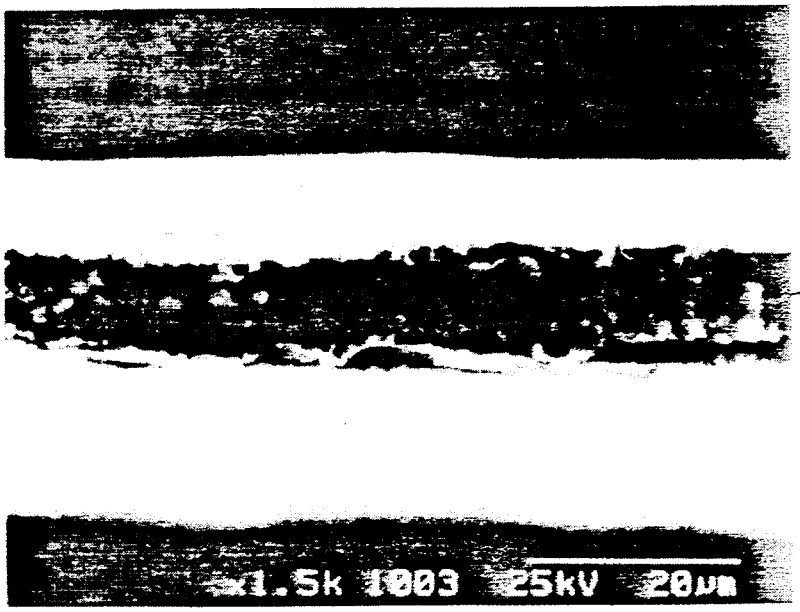
FIG. 10 is a microphotograph of the cut end face shown in FIG. 9 which is taken from before.

FIGS. 9 and 10 are microphotographies showing the cut end face of a stainless steel foil which was blanked according to the above-described method. In the blanking operation, the clearances of the dies were about 40% (5 μm) of the thickness of the metal foil, and the amounts of movement of the punches in the half blanking operation and in the reverse blanking operation were 30% of the thickness of the metal plate, and the half blanking operation and the reverse blanking operation were carried out ten times. The microphotography of FIG. 9 corresponds to a side view of the stainless steel foil. In the photography, the white part is the contour of the stainless steel foil blanked. More specifically, the white right and left lines are the foil surfaces, and the white bottom line the cut end face. The microphotography of FIG. 10 corresponds to a front view of the cut end face shown in FIG. 9. More specifically, the cut end face is extended horizontally in the middle portion of the photography. As is apparent from those photographs, no burrs were formed on the cut end face, and the upper and lower edges of the cut end face were smooth. In the photography of FIG. 10, the white regions above and below the cut end face are those formed by halation when the picture was taken, thus being not related to the cut end face.

Now, the blanking die sets used in the method of the invention will be described.

The parts (a) through (d) of FIG. 2 are to show a method of blanking a workpiece 17 with ordinary die sets with a relatively large clearance of from 50% to 100% of the thickness of the workpiece. That is, the part (a) of FIG. 2 shows an initial state that the workpiece 17 is clamped between the dies; the part (b), a state that the workpiece is punches midway; and the part (c), a state that the workpiece is punched in the opposite direction. That is, the half blanking operation and the reverse blanking operation are carried out alternately and repeatedly, as a result of which the workpiece 17 is finally cut as shown in the part (d) of FIG. 2. In the case where the die clearance is large relative to the thickness of a workpiece as was described above, then plastic deformation regions P are formed in the workpiece on both sides of the clearance, and finally deep cracks Q are formed in the plastic deformation region on the side of the part of the workpiece which is not sheared (being clamped between the dies 5 and 6) and they remain as they are; that is, the shearing of the workpiece is unsatisfactory. The formation of such deep cracks Q attributes to the fact that, during blanking, excessively large stress concentrates on the part of the workpiece which is held between the die.

Figure 3A:
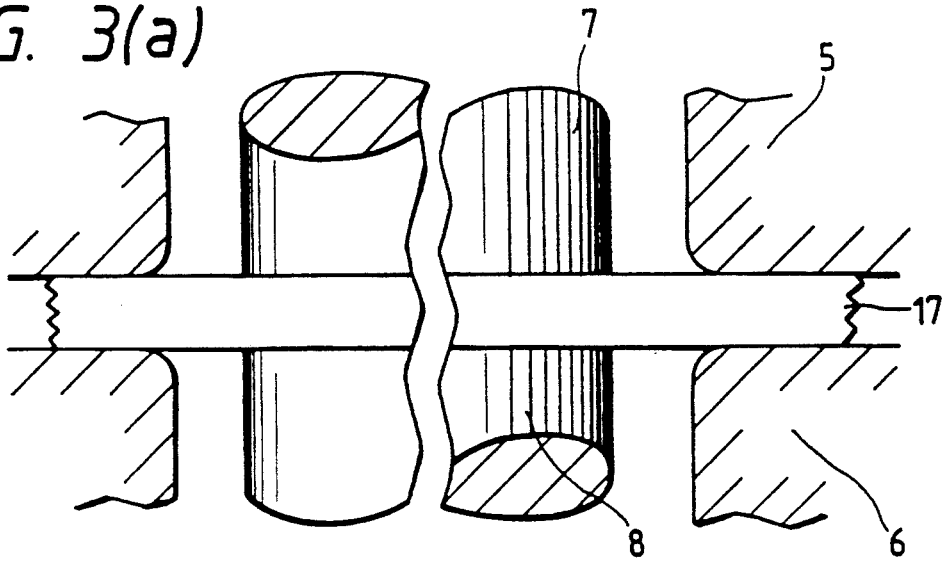
FIG. 3 shows the dies employed in the method of the invention, and the cut end faces of a workpiece blanked with the dies—more specifically, FIGS. 3(*a*) and (*c*) are explanatory diagrams showing the workpiece clamped between the dies, and the part (b) an explanatory diagram showing the cut end faces of the metal foil.
Figure 3B:
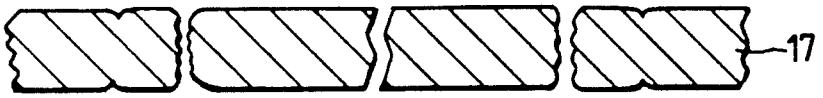
Figure 3C:
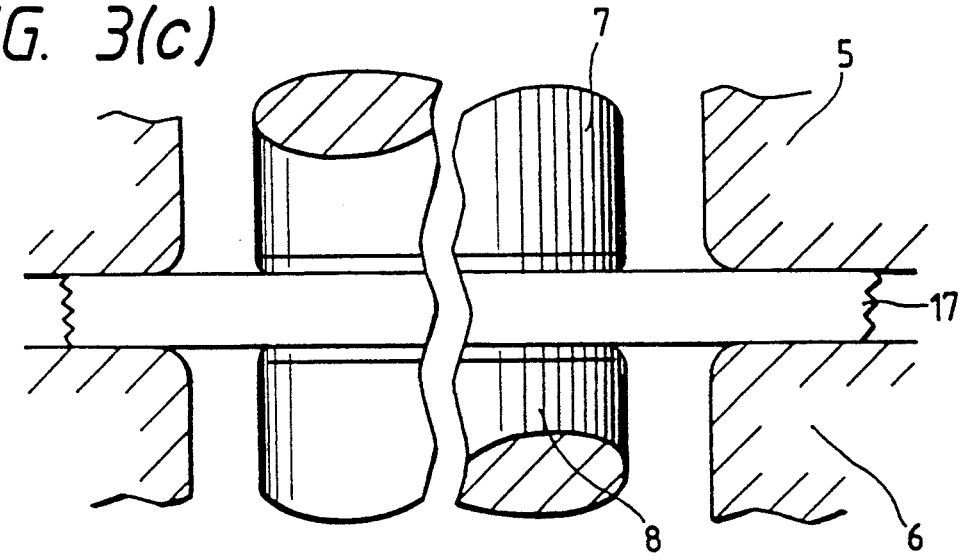

This difficulty is overcome by the invention as follows:

As shown in the part (a) of FIG. 3, the edges of the upper and lower dies 5 and 6 adapted to clamp the workpiece 7 are chamfered (or rounded or cut) in advance, to lessen the concentration of stress on the edges during blanking. As a result, as shown in the part (b) of FIG. 3, in the plastic deformation region which is on the side of the part of the workpiece which is not sheared, the deep cracks Q as shown in the part (d) of FIG. 2 are scarcely formed although small dents are formed. The same effect can be obtained by chamfering the punches 7 and 8 instead of the dies 5 and 6, as shown in FIG. 3(*c*).

Figure 4:
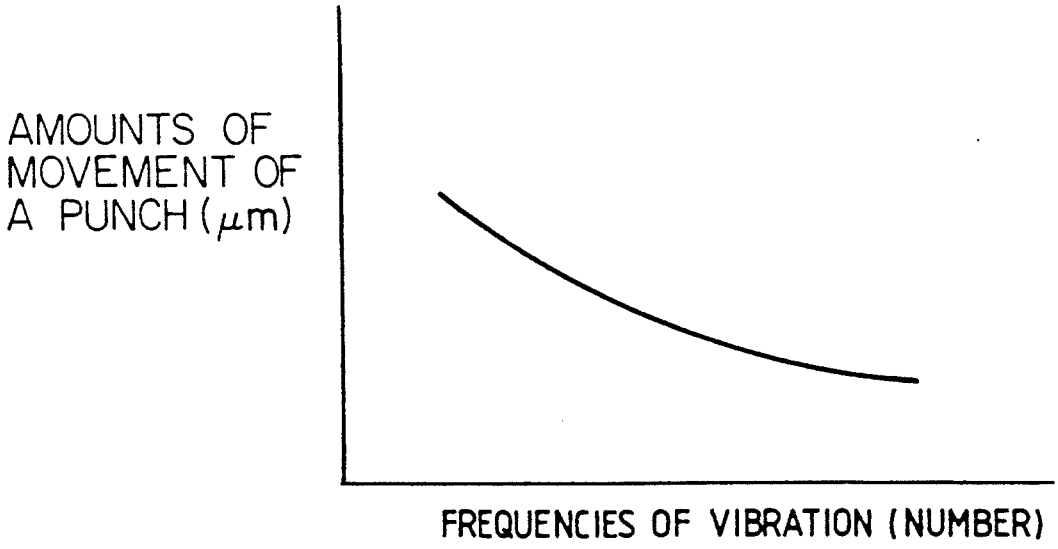
FIG. 4 is a graphical representation indicating amounts of movement of a punch with frequencies of vibration of the punch in shearing a workpiece according to the method of the invention.

FIG. 4 indicates relationships between amounts of movement of each of the punches and frequencies of vibration of the punch (or numbers of repetition of the half blanking operation and reverse blanking operation). As is seen from FIG. 4, in the case where the amount of movement of the punch is large, the workpiece can be sheared with a low frequency of movement of the punch; and in the case where the amount of movement of the punch is small, it is necessary to increase the frequency of vibration of the punch. A suitable amount of movement of the punch depends on the material of the workpiece; that is, it should be large for a soft material, and small for a hard material.

As was described above, in the metal foil blanking method of the invention, the piezoelectric actuators capable of controlling position in the order of microns are employed as punch driving sources, and the punches are vibrated by the piezoelectric actuators so that, while the punches being held abutted against both surfaces of the workpiece clamped between the dies, the half blanking operation and the reverse blanking operation are carried out repeatedly. Hence, the thin metal foil several tens of micrometers (μm) in thickness can be blanked without formation of burrs which is difficult for the conventional reciprocating blanking method to blank without formation of burrs.

Furthermore, according to the method of the invention, the blanking of a workpiece can be achieved without formation of burrs even if the die clearance is more than 10% of the thickness of the workpiece. The method is more effective with the edges of the dies or those of the punches chamfered. That is, even when the die clearance is large, 50 to 100% of the thickness of the workpiece, the concentration of stress on the workpiece is lessened, so that formation of cracks and burrs by double shearing can be positively prevented.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A method of blanking a metal foil on a press having upper and lower dies, upper and lower punches, and upper and lower piezoelectric actuators for driving the upper and lower punches, comprising the step of:

clamping said metal foil between said upper and lower dies; and vibrating vertically said upper and lower punches by alternately applying positive and negative voltages to said upper and lower piezoelectric actuators to alternately perform a half blanking operation and a reverse blanking operation on the metal foil, wherein the negative voltage is applied to one of the piezoelectric actuators at a predetermined time after the positive voltage is applied to the other piezoelectric actuator during each half blanking and reverse blanking operation so that the metal foil is supported by both the upper and lower punches during the half blanking and reverse blanking operations.

2. A method according to claim 1, wherein, in each of said half blanking operation and reverse blanking operation, the amount of movement of said punch is 10 to 40% of the thickness of said metal foil.

3. A method according to claim 1, wherein edges of said upper and lower dies are chamfered.

4. A method according to claim 1, wherein edges of said upper and lower punches are chamfered.

5. A method of blanking a metal foil on a press having upper and lower dies, upper and lower punches, and upper and lower piezoelectric actuators for driving the upper and lower punches, comprising the steps of:

clamping the metal foil between the upper and lower dies so that the upper and lower punches are spaced apart from the metal foil;

applying a positive voltage to the lower piezoelectric actuator to drive the lower punch into supporting contact with the metal foil; and alternately performing at least one half blanking operation and at least one reverse blanking operation on the metal foil, the half blanking operation including applying a positive voltage to the upper piezoelectric actuator for the first predetermined period to drive the upper punch into the metal foil and applying a negative voltage to the lower piezoelectric actuator during the first predetermined period to retract the lower punch at a time delay after the initiation of the first predetermined period so that the lower punch supports the metal foil, the reverse blanking operation including applying a positive voltage to the lower piezoelectric actuator for a second predetermined period to drive the lower punch into the metal foil while the upper punch supports the metal foil.

6. The method of claim 5, wherein the reverse blanking operation is initiated prior to the end of the first predetermined period.

7. The method of claim 5, including pushing a blanked part of the metal foil into alignment with the metal foil with one of the upper and lower punches after the performance of the half blanking and reverse blanking operations.

8. The method of claim 5, wherein the reverse blanking operation includes applying a negative voltage to the upper piezoelectric actuator to retract the upper punch during the second predetermined period at a time delay after the initiation of the second predetermined period.

* * * * *

UNITED STATES PATENT AND TRADEMARK OFFICE

CERTIFICATE OF CORRECTION

PATENT NO. : 5,320,013

DATED : June 14, 1994

INVENTOR(S) : Mitsuharu Nonami, et al.

It is certified that error appears in the above-indentified patent and that said Letters Patent is hereby corrected as shown below:

On the title page: Line 3 of the Abstract, "with" should read --which--.

Claim 1, Column 8, Line 2 "step" should read --steps--.

Claim 5, Column 8, Line 40 "the" should read --a--.

Signed and Sealed this

Twenty-first Day of February, 1995

*Attest:*

*Attesting Officer*

BRUCE LEHMAN

*Commissioner of Patents and Trademarks*